United States Patent [19]

Neyret et al.

[11] Patent Number: 4,989,728

[45] Date of Patent: Feb. 5, 1991

[54] CIGARETTE PACKAGE UNIT INCORPORATING A MATCH DRAWER

[76] Inventors: Stéphane Neyret, 4 avenue Bouon, 75016 Paris, France; Patrick Verilhac, 15 Boulevard Gambetta, 38000 Grenoble, both of France

[21] Appl. No.: 289,354

[22] Filed: Dec. 23, 1988

[30] Foreign Application Priority Data

Dec. 23, 1987 [FR] France ..... 87 18089

[51] Int. Cl.[5] ..... B65D 5/18; B65D 5/66; B65D 25/04; B65D 5/48

[52] U.S. Cl. ..... 206/91; 206/248; 206/273; 229/160.1

[58] Field of Search ..... 206/273, 248, 91, 86, 206/246; 229/160.1

[56] References Cited

U.S. PATENT DOCUMENTS

| | | | |
|---|---|---|---|
| 2,306,613 | 12/1942 | Chesley | 206/248 |
| 3,915,295 | 10/1975 | Morrison . | |
| 4,753,384 | 6/1988 | Focke et al. | 206/273 |

FOREIGN PATENT DOCUMENTS

| | | | |
|---|---|---|---|
| 2581040 | 10/1986 | France | 206/273 |
| 654837 | 6/1963 | Italy | 206/91 |
| 1036133 | 7/1966 | United Kingdom | 206/91 |
| 2046218 | 11/1980 | United Kingdom | 229/160.1 |
| 2151212 | 7/1985 | United Kingdom | 229/160.1 |

*Primary Examiner*—Paul T. Sewell
*Assistant Examiner*—Jacob K. Ackun, Jr.
*Attorney, Agent, or Firm*—Browdy and Neimark

[57] ABSTRACT

The cigarette package unit is composed of an outer envelope defining a rectangular parallelepipedal volume similar to that of conventional cigarette packages and which contains an inner rectangular parallelepipedal compartment adapted for receiving the cigarettes. The outer envelope has side walls made of front and rear flaps shorter than a total height of the outer envelope and being connected to respective front and rear faces of the envelope while defining therebetween a rectangular cut-out. A hollow space is formed between the bottom of the outer envelope and the bottom of the inner compartment and in which is placed a match drawer containing a number of matches which is substantially equal to a number of cigarettes.

5 Claims, 3 Drawing Sheets

FIG. 4
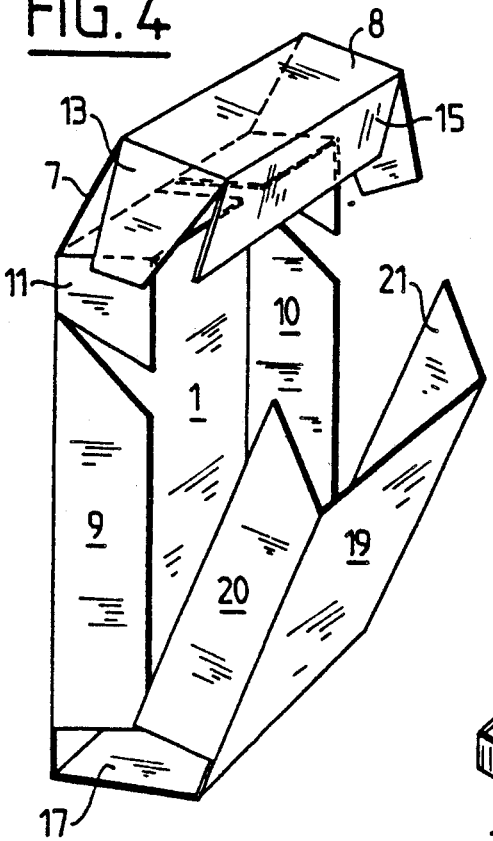
FIG. 5
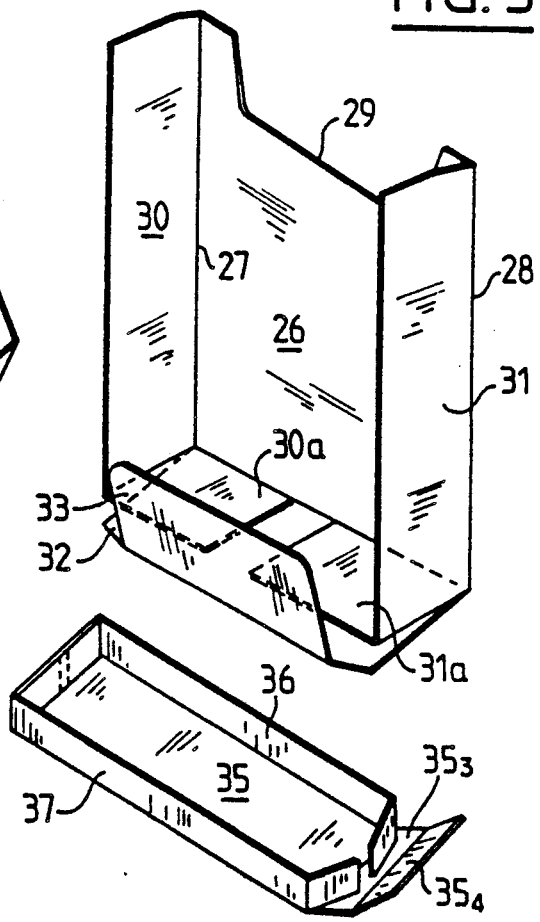
FIG. 6
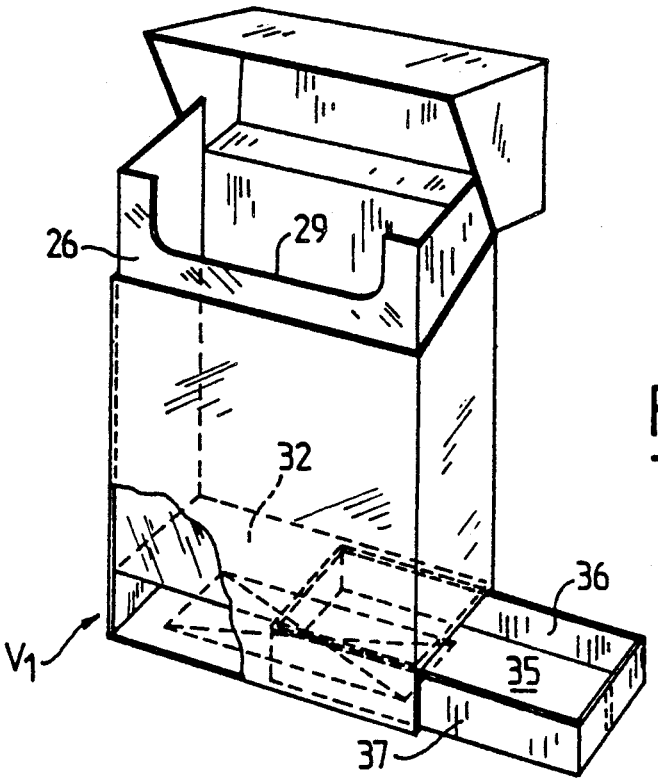
FIG. 7

CIGARETTE PACKAGE UNIT INCORPORATING A MATCH DRAWER

FIELD OF THE INVENTION

This invention relates to cigarette packaging and particularly to a cigarette package unit incorporating a match drawer.

BACKGROUND OF THE INVENTION

Up to now, packages for cigarettes have been made either in glazed paper with an inside protection in a metallic paper and an outside coating made of a plastics film, or by a rectangular parallelepipedal cardboard box unit containing cigarettes wrapped inside a protection made of a metallized paper, the unit being outsidely covered by an envelope made of a film of transparent plastics material.

However, and although these packages have given satisfaction for packaging of cigarettes, it has been necessary to supply smokers, in addition to these packages, with a separate pocket of matches. This pocket of matches is readily lost or forgotten, thereby preventing the smoker from lighting a cigarette at the desired moment.

Improvements have been brought to the foregoing prior art by British patent No. 2,046,218 in which the package is such that it incorporates automatically a match box placed directly underneath a portion containing the cigarettes, and this directly by a simple folding operation after having cut out a cardboard blank.

The package according to the hereabove prior art document relates thus to a cigarette package having an envelope with side walls which are made of front and rear flaps, the front flaps of these side walls extending into extra flaps which are not connected to the respective front and rear walls of the envelope and are provided for forming an upper bottom for the envelope by defining a space with a lower bottom of the envelope, this space being provided for housing a match drawer.

Due to the above mentioned extra flaps which it is necessary to glue, there is defined an overthickness against which will abut the upper portion of a match drawer when sliding inside the space thus formed in the cigarette package between the upper bottom and the lower bottom of the envelope.

After a certain period of handling use, the hereabove overthickness prevents the match drawer from sliding correctly. Moreover, due to the fact that these extra flaps are simply bearing perpendicular against the respective front and rear walls of the envelope, there is formed a slight interval making possible a passage of the matches from the portion containing the matches to the portion housing the cigarettes, or a passage of the tobacco between the portion housing the cigarettes and the portion containing the matches.

OBJECTS AND SUMMARY OF THE INVENTION

The present invention remedies the hereabove disadvantages by providing a cigarette package unit incorporating a zone totally separated therefrom and provided for containing a drawer which is easily handled and can be of any suitable height, which drawer contains a number of matches which can be easily used with a friction section or scraper member provided underneath the bottom of the envelope of the cigarette package unit, thereby providing a package unit of a perfectly conventional shape, very little bulky with respect to the volume of known cigarette package units, and of an acceptable cost price. Moreover, even if the surface of cardboard used is slightly more than the surface of cardboard used for conventional cigarette packages, and since cut-out studies have been carried out very seriously, the cardboard scraps caused with the conventional cigarette packages have practically been eliminated and, therefore, the final cost price is practically not modified.

According to the invention, the cigarette package unit incorporating a match drawer is composed of an outer envelope defining a rectangular parallelepipedal volume similar to that of conventional cigarette packages and which contains an inner rectangular parallelepipedal compartment intended for receiving the cigarettes, is characterized in that the outer envelope has side walls made of front and rear flaps which are shorter than a total height of the outer envelope, the flaps being connected to respective front and rear faces of the outer envelope and defining a rectangular cut-out therebetween so as to provide a hollow space above a bottom of this outer envelope, an upper wall of which hollow space being made by a bottom of the inner compartment and defining a volume $V_1$ at a lower portion of the outer envelope, in which volume $V_1$ is placed a match drawer in a shape of a cover free parallelepipedal box containing a number of matches which is substantially equal to a number of the cigarettes. The match drawer is able to slide in the volume $V_1$ in an easy and binding-free manner.

Various other features of the invention will become more apparent from the following detailed description.

BRIEF DESCRIPTION OF THE DRAWINGS

An embodiment of the invention is shown by way of a non limiting example in the accompanying drawings, wherein:

FIG. 4 is a perspective view of the outer envelope during the mounting operation;

FIG. 5 is a perspective view of the inner compartment during the mounting operation;

FIG. 6 is a perspective view of the match drawer during the mounting operation;

FIG. 7 is a partly cut-out perspective view of the cigarette package unit with its match drawer;

DETAILED DESCRIPTION OF A PREFERRED EMBODIMENT

Figure 1:
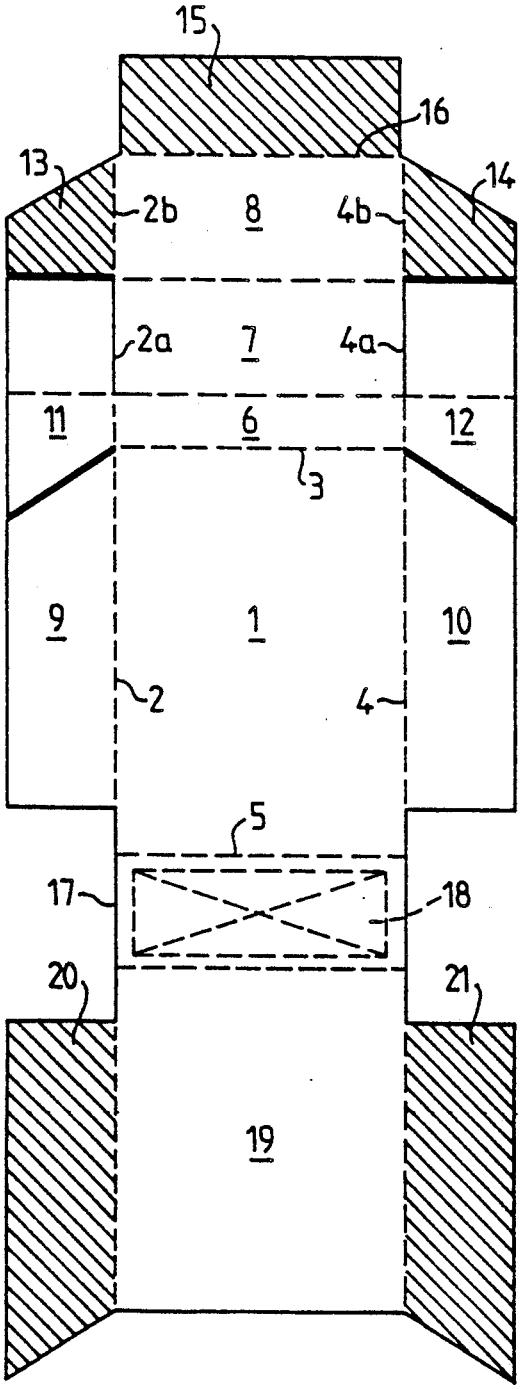
FIG. 1 is a plan view of a blank for an outer envelope of the cigarette package unit according to the invention.

FIG. 1 shows in a plan view the outer envelope of the cigarette package unit which includes a rear face 1 of a rectangular shape defined by folding lines 2, 3, 4, 5. The folding line 3 is prolongated by a rectangular wall 6, then by a wall 7 also of a rectangular shape, and finally by a rectangular wall 8. The rear face 1 is laterally provided with two flaps 9, 10 of a trapezoidal shape while the walls 6 and 7 are prolongated laterally by flaps 11, 12 also trapezoidal in shape but completing in length the flaps 9, 10. Finally, the wall 8 presents two side trapezoidal flaps 13, 14 and, in its prolongation, a flap 15 intended for being glued onto the lower portion of the wall 8 in order to reinforce it.

The folding lines 2 and 4 are prolongated at *2a*, *2b*, *4a*, *4b* in order to permit a back folding over 90° of the various flaps 11, 12, 13, 14. The flap 15 is separated from the wall 8 by a folding line 16.

The bottom 17 of the cigarette package unit has a rectangular shape, with an outer face provided with a scraper 18 and the front of the cigarette package unit is made of a panel 19 of a rectangular shape, smaller than the rear face 1. The panel 19 is prolongated laterally by flaps 20, 21 of a trapezoidal shape, identical to that of the flaps 9, 10 on which they are glued, as described hereafter.

Figure 2:
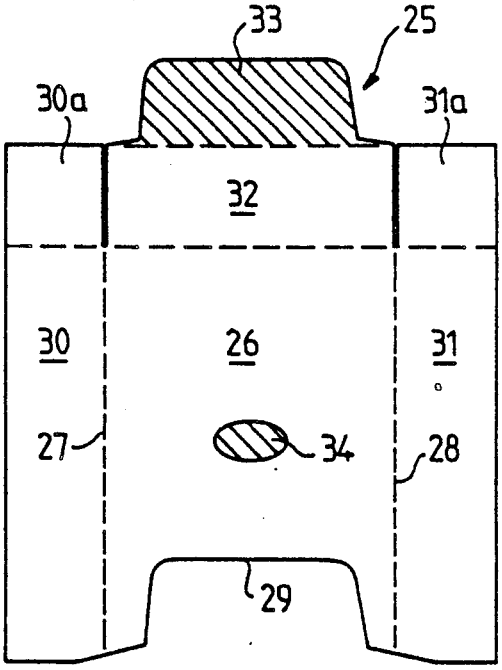
FIG. 2 is a plan view of a blank for an inner compartment of the cigarette package unit.

As shown in FIG. 2, the inner compartment 25 intended for containing the cigarettes is composed of a central panel 26 defined laterally by folding lines 27, 28. Moreover at its upper portion the inner compartment 25 presents a cut-out 29 which is substantially of a rectangular shape. The folding lines 27, 28 are prolongated by flaps 30, 31.

The central panel 26 is prolongated at its lower portion by a rectangular bottom wall 32 ending into a tongue 33 which is glued to the lower portion of the rear face 1 of FIG. 1 just on the transverse rectilinear separation line of the flaps 9, 10. The wall 32 is rigidified in the transverse direction by lugs 30*a*, 31*a* prolongating the flaps 30, 31.

Reference numeral 34 designates a fixation glue point of the inner compartment 25 to the front panel 19 of the outer envelope.

Figure 3:
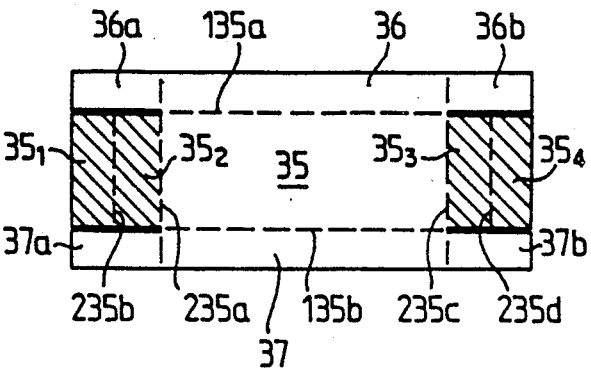
FIG. 3 is a plan view of a blank for a match drawer intended for the cigarette package unit once mounted.

Finally, FIG. 3 is a plan view of a match drawer composed of a rectangular bottom 35 prolongated by two tongues 36, 37 of height equal to that of the finished drawer and prolongated by lugs 36*a*, 36*b*, 37*a*, 37*b*. The bottom 35 is in turn prolongated in the transverse direction by two pairs of walls $35_1$, $35_2$, $35_3$, $35_4$.

The bottom 35 of the match drawer is defined by folding lines 135*a*, 135*b*, and the lugs and walls $35_1$, $35_2$, $35_3$, $35_4$ are also defined by folding lines 235*a*, 235*b*, 235*c* and 235*d*.

As shown in FIG. 6, when the tongues 36, 37 are straightened out, the lugs 36*a*, 36*b*, 37*a*, 37*b* are sandwiched between the walls $35_1$, $35_2$, $35_3$, $35_4$ in order to form a rectangular parallelepipedal box opened at its upper portion and forming thus the match drawer.

As clearly shown in FIGS. 4, 5 and 7, the cigarette package unit is made of the outer envelope of FIG. 1 composed of the rear wall 1, the front panel 19 and of the flaps 9, 10, 20, 21, as well as the lid made by the walls 7, 8 conveniently locked by the flap 15 and flaps 11, 12, 13, 14.

Thus, the outer envelope 1 defines an empty space at its lower portion between the bottom 17 and the flaps 9, 20, 10, 21. The inner compartment shown in FIG. 5, is then introduced into the outer envelope so that the wall 32 forming a bottom for the inner compartment is in a horizontal position, just on the zone placed above a lower area provided underneath the flaps 9, 20, 10, 21, with the lugs 30*a* and 30*b* above the bottom wall as shown in FIG. 5. There is thus provided an empty space $V_1$, which is clearly visible in FIG. 7, and which is occupied by the match drawer of FIG. 6. Actually, tongues 36, 37 are just of a height sufficient for enabling an easy sliding motion of the match drawer between the bottom 32 of the inner compartment containing the cigarettes and the bottom 17 of the outer envelope.

Thus, with a cigarette package unit of a volume slightly superior to that of a conventional cigarette package, there is obtained a combined cigarette package-match drawer unit, affording the same advantages as regards manufacturing (cutting, folding and glueing in a continuous manner) and printing the pictograms. The lines of junction of the cigarette package with the match drawer do not appear on the anterior and posterior faces of the final package unit. Thus, this package unit has the same aesthetic appearance as conventional cigarette packages. Finally, a protection made of a metallic paper can be provided for the cigarettes, as well as an outer plastic film, just as with conventional cigarette packages.

Figure 8:
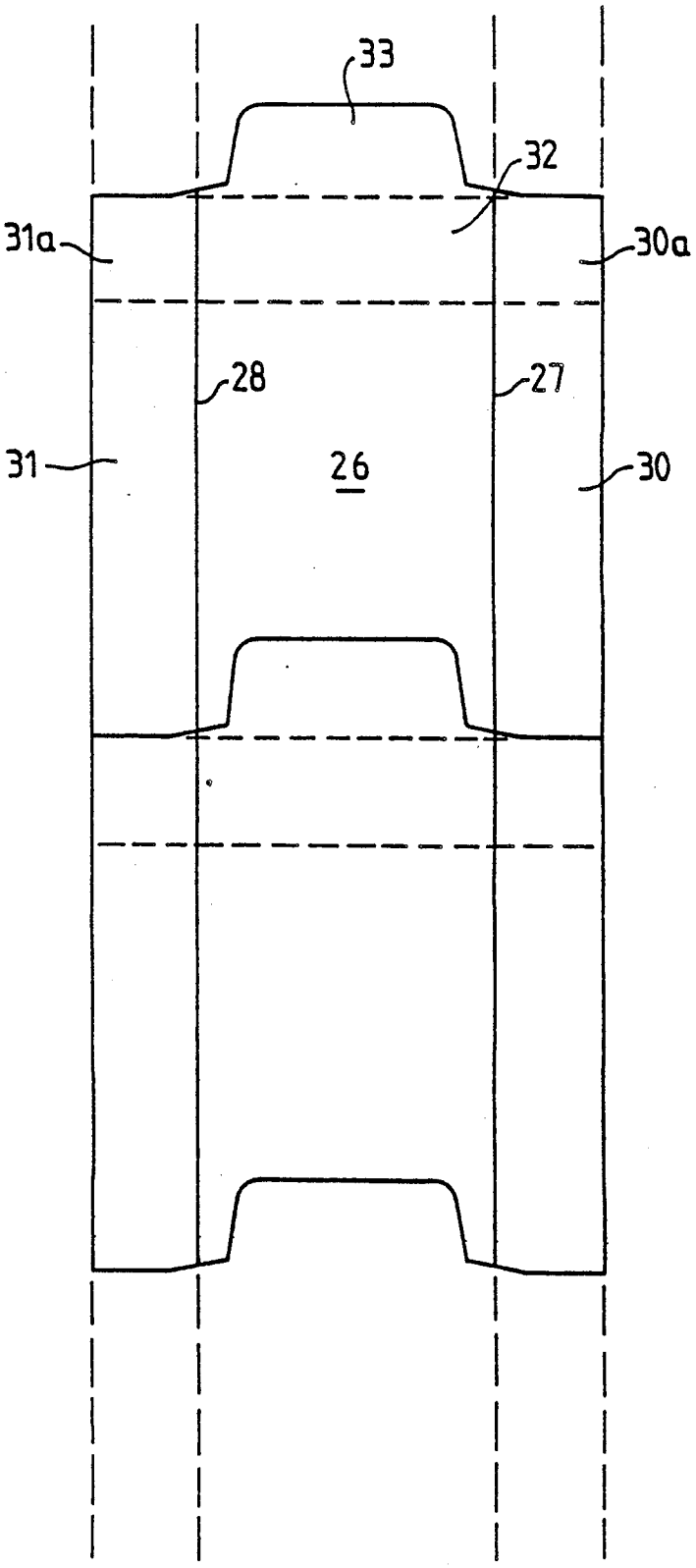
FIG. 8 is a plan view showing a continuous manufacturing process of the inner compartment, while avoiding any loss of cardboard.

Furthermore, and as shown in FIG. 8, the inner compartment can be manufactured without any loss of cardboard.

While a scraper for the matches contained in the drawer 35 has been particularly shown at 18 on the outer face of the bottom 17 of the cigarette package unit, the scraper can be placed in various locations, particularly underneath the face 35 of the drawer intended for containing the matches so as to hide this scraper and to thereby improve the aesthetic appearance of the finished cigarette package unit.

What is claimed is:

1. A cigarette package unit incorporating a match drawer, composed of:

an outer envelope having an interior defining a rectangular parallelepipedal volume similar to that of conventional cigarette packages and made from a single blank of material, and which contains an inner compartment made from a second blank of material comprising a substantially continuous bottom wall foldably attached to a central panel and tongue, said panel and tongue being glued to the interior of said outer envelope above said continuous wall, said inner compartment being adapted for receiving the cigarettes, and wherein the outer envelope has side walls made of front and rear flaps, said flaps being shorter than a total height of the outer envelope and being connected to respective front and rear faces of the outer envelope while defining therebetween a rectangular cut-out so as to form a three sided hollow space including a bottom of said outer envelope, said inner compartment being so glued to the interior of said outer envelope so that said substantially continuous bottom wall of said inner compartment constitutes a fourth side and an upper wall of said hollow space and defines, at a lower portion of the outer envelope, a volume $V_1$ in which is slidably retained a match drawer in a shape of a cover free parallelepipedal box containing a number of matches which is substantially equal to a number of cigarettes, wherein said substantially continuous bottom wall of the inner compartment as held in place by said glued panel and tongue constitutes a rigid and secure means for insuring easy and binding-free sliding motion of said match drawer in said volume $V_1$ and simultaneously in combination with said panel and tongue constitutes means for assuring that tobacco from cigarettes do not enter said match drawer.

2. A cigarette package unit as set forth in claim 1, wherein a lower face of the bottom (17) of said outer envelope is provided with a scraper (18) for the matches.

3. A cigarette package unit as set forth in claim 1, wherein said match drawer has a bottom (35) with an underneath face provided with a scraper (18) for lighting the matches contained in the match drawer.

4. A cigarette package unit incorporating a match drawer, comprising an outer envelope made from a single blank of material defining therewithin a rectangular parallelepipedal volume, said outer envelope comprising side walls of front and rear flaps, said front and rear flaps being shorter than a total height of the outer envelope and being connected to respective front and rear faces of said outer envelope while defining therebetween a rectangular cut-out forming a three sided hollow space including a bottom of said outer envelope;

an inner compartment made from a second blank of material and adapted for receiving the cigarettes, said inner compartment being disposed within said outer envelope and having a central panel glued above a substantially continuous bottom wall to said front face of said outer envelope interiorally thereof, the substantially continuous bottom wall forming a fourth side and an upper wall of said hollow space of said outer envelope, said bottom wall and said central panel of said inner compartment being separated by a fold line, and a tongue glued above said bottom wall to said rear face of said outer envelope interiorally thereof, said bottom wall being connected to said tongue by a fold line; and a match drawer slidably retained in said hollow space in an easy and binding-free manner.

5. A cigarette package unit incorporating a match drawer, comprising an outer envelope defining therewithin a rectangular parallelepipedal volume made from a single blank of material, said outer envelope comprising side walls of front and rear flaps, said front and rear flaps being shorter than a total height of the outer envelope and being connected to respective front and rear faces of said outer envelope while defining therebetween a rectangular cut-off forming a three sided hollow space including a bottom of said outer envelope;

an inner compartment made from a second blank of material and adapted for receiving the cigarettes, said inner compartment being disposed within said outer envelope and having a central panel adjacent said front face of said outer envelope interiorally thereof, the central panel being disposed above a substantially continuous bottom wall, the substantially continuous bottom wall forming a fourth side and an upper wall of said hollow space of said outer envelope, said bottom wall and said central panel of said inner compartment being separated by a fold line, and a tongue adjacent said rear face of said outer envelope interiorally thereof and disposed above said bottom wall, said bottom wall being connected to said tongue by a fold line; and a match drawer slidably retained in said hollow space, said substantially continuous bottom wall of said inner compartment constituting means for ensuring easy and binding-free sliding motion of said drawer in said hollow space.

* * * * *